US007451704B1

(12) United States Patent
Gold et al.

(10) Patent No.: US 7,451,704 B1
(45) **Date of Patent: *Nov. 18, 2008**

(54) MULTIFUNCTIONAL EXPLOSIVE FRAGMENTATION AIRBURST MUNITION

(75) Inventors: Vladimir Gold, Hillside, NJ (US); Ernest L. Baker, Wantage, NJ (US); William J. Poulos, River Vale, NJ (US)

(73) Assignee: The United States of America as represented by the Secretary of the Army, Washington, DC (US)

( * ) Notice: Subject to any disclaimer, the term of this patent is extended or adjusted under 35 U.S.C. 154(b) by 218 days.

This patent is subject to a terminal disclaimer.

(21) Appl. No.: 11/162,470

(22) Filed: Sep. 12, 2005

Related U.S. Application Data

(63) Continuation-in-part of application No. 11/011,022, filed on Dec. 3, 2004, now Pat. No. 6,983,699, which is a continuation of application No. 10/249,479, filed on Apr. 14, 2003, now abandoned.

(60) Provisional application No. 60/320,027, filed on Mar. 20, 2003, provisional application No. 60/595,315, filed on Jun. 22, 2005.

(51) Int. Cl.
*F42B 12/22* (2006.01)
*F42B 12/24* (2006.01)
*F42B 12/32* (2006.01)

(52) U.S. Cl. ..... 102/495; 102/494; 102/496

(58) Field of Classification Search ..... 102/494–496
See application file for complete search history.

(56) References Cited

U.S. PATENT DOCUMENTS

| | | | | | |
|---|---|---|---|---|---|
| 2,246,429 | A * | 6/1941 | Brandt | ..... | 102/519 |
| 3,157,137 | A * | 11/1964 | Burns, Jr. | ..... | 102/509 |
| 3,731,633 | A * | 5/1973 | Davis | ..... | 102/495 |
| 3,820,464 | A * | 6/1974 | Dixon | ..... | 102/493 |
| 3,882,779 | A * | 5/1975 | Frostig | ..... | 102/496 |
| 4,312,274 | A * | 1/1982 | Zernow | ..... | 102/493 |
| 4,327,643 | A * | 5/1982 | Lasheras Barrios | ..... | 102/493 |
| 4,515,083 | A * | 5/1985 | Caruso | ..... | 102/493 |
| 4,967,667 | A * | 11/1990 | Horwath | ..... | 102/494 |
| 6,543,365 | B1 * | 4/2003 | Vasel et al. | ..... | 102/502 |
| 6,598,534 | B2 * | 7/2003 | Lloyd et al. | ..... | 102/494 |
| 6,779,462 | B2 * | 8/2004 | Lloyd | ..... | 102/475 |
| 6,983,699 | B1 * | 1/2006 | Gold et al. | ..... | 102/495 |
| 2003/0029347 | A1 * | 2/2003 | Lloyd | ..... | 102/489 |

* cited by examiner

*Primary Examiner*—Bret Hayes
(74) *Attorney, Agent, or Firm*—Michael Sachs

(57) ABSTRACT

An explosive fragmentation munition having a longitudinal axis which includes a cylindrical shell portion having a thickness and an interior; a rounded shell portion having a thickness and an interior, the rounded shell portion being disposed at a front end of the cylindrical shell portion; an explosive disposed in the interiors of the cylindrical shell portion and the rounded shell portion; wherein the thickness of the rounded shell portion equals the thickness of the cylindrical shell portion where the rounded shell portion joins the cylindrical shell portion, and wherein the thickness of the rounded shell portion increases in a forward direction along the longitudinal axis.

19 Claims, 12 Drawing Sheets

MULTIFUNCTIONAL EXPLOSIVE FRAGMENTATION AIRBURST MUNITION

CROSS REFERENCE TO RELATED APPLICATIONS

This application is a continuation-in-part of application Ser. No. 11/011,022 filed Dec. 3, 2004, now issued as U.S. Pat. No. 6,983,699, which in turn is a continuation of application Ser. No. 10/249,479 as originally filed on Apr. 14, 2003, now abandoned, by Vladimir Gold and Ernest L. Baker, for "Explosive Fragmentation Munition", which itself claims benefit under 35 USC 119(e) of U.S. provisional application No. 60/320,027 filed Mar. 20, 2003, the entire file wrapper contents of which applications are hereby incorporated by reference as though fully set forth. This application also claims benefit under 35 USC 119(e) of U.S. provisional application No. 60/595,315 filed Jun. 22, 2005, the entire file wrapper contents of which application are hereby incorporated by reference as though fully set forth.

STATEMENT OF GOVERNMENT INTEREST

The inventions described herein may be manufactured, used and licensed by or for the U.S. Government for U.S. Government purposes.

BACKGROUND OF THE INVENTION

The invention relates to a multifunctional airburst explosive fragmentation munition with improved fragment spray aerial coverage and fragment mass distribution that can be launched from small, medium and large caliber high velocity gun systems. The technical feasibility of the present invention is based on recent advances in miniaturized electronic fuse control systems with improved intelligence and reliability, permitting a round to assess its position at a pre-determined location within approximately ±5 meters from target. This enables a munition to function in a number of modes including airburst mode, point impact mode, and delayed initiation mode. In the delayed detonation mode, the munition can act as a high-strength kinetic energy projectile capable of breaching light armor and reinforced concrete and masonry walls in urban terrain military operations.

In the airburst fragmentation mode, the munition is detonated in the air at a location near the target projecting fragments in a forward direction. This results in high fragment density in a radial distribution around the detonated shell, including the direction of travel, which maximizes the lethal area of the fragment engagement "footprint" at the target.

The present invention achieves an optimal use of materials for lethality requirements against a number of targets, including full body armor combat personnel, lightly armored combat vehicles, personnel carriers, mobile radar stations, urban structures, etc. Multifunctional capabilities are possible within a single round of ammunition, with destructive capabilities superior to current fragmentation approaches such as hand or rocket launched grenades and for both anti-vehicle and anti-personnel destruction. Such ammunition comprises projectiles with specially designed warheads in the frontal areas and can be 40 mM to 120 mM caliber Tank Rounds, e.g., or even in bullet form. The warheads ultimately break into pieces (fragments) which have comparatively higher velocity and relatively larger total mass than for instance, hand thrown grenades, greatly increasing the destructive power. Design of the warhead liner enables fragment direction of flight to be reasonably well chosen. A one-piece solid, high mass of material may be positioned in the front of the warhead which will fragment and it will spray the frontal and side targets with fragments. However, the fragments will all be relatively large in size and all about the same diameter. These larger fragments are good against a vehicle target. However, rather than a one-piece solid, high mass of material in front it is preferred to have such added material made up of one or more layers ("liners") where each liner by itself is less in mass, but together all the layers constitute the desired high mass of material in front.

The liners create two types of fragments in one warhead, numerous smaller diameter fragments which are anti-personnel, plus higher mass larger diameter fragments, which are anti-vehicle, thus dual purpose, and can be similarly made for multiple purposes. The anti-personnel fragments, though smaller in diameter, are more numerous in the number of fragments than what would result from a one-piece, solid high mass of material in the front. The significantly larger quantity of fragments will spray the area well and although smaller in diameter, are adequate and thus preferred to do the anti-personnel function. The larger mass fragments, though fewer in number, are still adequate for the anti-vehicle function.

The projectile takes advantage of the extremely high launch velocities as contrasted to a hand thrown grenade. This propels at a greater velocity, plus with a larger mass than in a hand thrown grenade, mass in the front areas, which can be more successfully used for anti-vehicle, anti-personnel missions. The hand thrown grenade destructive ability is primarily due to its own explosion and disintegration, driving the pieces as fragments in various directions. A hand grenade's walls are relatively thinner to facilitate explosion, but that leaves comparatively less mass of the fragments from such thinner wall mass, to have the destructive power, and lower velocity in a (desired) forward direction compared to a round. As mentioned, in this invention relatively greater mass can be employed in a frontal warhead such as FIG. 4, FIG. 6A and FIG. 2C. More precise design of the warhead liner shapes that are employed in this invention, enable a finer result of directional choice for propelling the fragments.

It is possible to have near perfect coverage of moving fragments in the areas needed to successfully kill personnel and destroy vehicles (such as in FIG. 3D ideal front direction coverage), in a fan shape pattern looking down on a cross-section of the field of fragment distribution. The warhead liners' cross-sectional shapes, might be designed on a computer provisionally to follow a third order parametric polynomial curve (nine degrees of freedom). This mathematically modeled curve allows for more tailored shaping (through iterations) of the warhead shape which seems best in testing for superior kill results. It is further possible to design the warheads with embedded fragments of selected grain diameter sizes (FIG. 4) specially chosen for the targets, with chosen packing densities as a further factor in the warhead's lethality. For instance, smaller grain sizes adequate to kill personnel, and larger grain sizes are included as well, to kill light vehicles (or perhaps to destroy radar sights, missiles, armor, wooden or tile walls, or timber, clearing of a forest area, destroying gypsum, wood, masonry, concrete, brick or block walls in Urban Terrain Military Operations, being mission targets, e.g.). Various mechanisms are discussed which can cause successful breakup of the warhead into desired fragments of various sizes and velocities, including pre-embedding fragments (FIG. 4), scoring of the warhead outer surfaces (FIG. 5), or having small holes made in the warhead (FIGS. 6B-6G) such as by drilling small dimple-like holes in the projectile's front cap area, or employing multiple liner warheads (FIG. 6A). A brief description of the present invention is as follows.

BRIEF DESCRIPTION OF THE DRAWINGS

In the drawings which are not necessarily to scale, like or corresponding parts are denoted by like or corresponding reference numerals.

DETAILED DESCRIPTION OF THE PREFERRED EMBODIMENTS

Figure 1A:
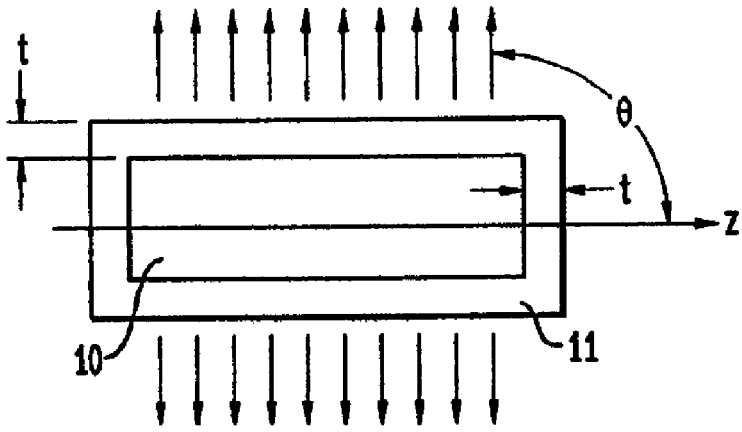
FIG. 1A shows an idealized geometry for an airburst explosive fragmentation shell; it includes an idealized cylindrical shell 11 of uniform thickness t, and includes explosive 10 within.
Figure 1B:
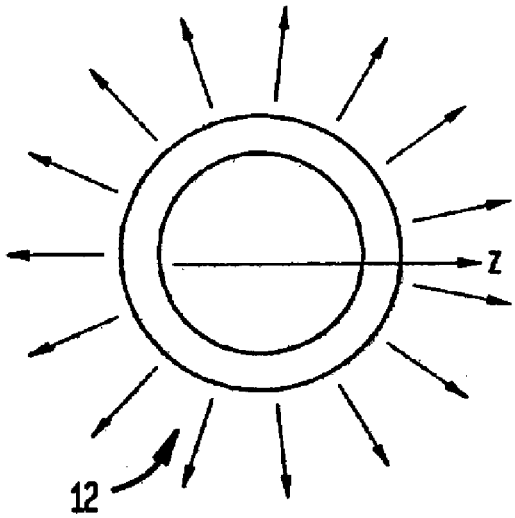
FIG. 1B shows a fragment spray pattern of an idealized spherical shell device.

Examples of possible idealized geometries for the airburst explosive fragmenting shell are shown in FIG. 1. Upon initiation of the high explosive charge, rapid expansion of high-pressure high-velocity detonation products results in high-strain, high-strain-rate dilation of the metal shell encapsulating the explosive, which eventually ruptures generating a spray of high-velocity fragments moving with trajectories at angles Θ with the z-axis. Accordingly, the principal lethality parameter of the explosive fragmenting shell is the number of fragments as a function of the angle Θ, which determines the statistical probability of incapacitation of the assaulted target and, ultimately, overall efficiency of the munition. Assuming that the changes in the trajectories of the fragments due to air resistance are negligible, the angular distribution of the fragment spray is a function of the initial geometry of the fragmenting shell's surface, the strength, the density, and the thickness thereof.

For example, in the case of an idealized cylindrical shell of uniform thickness t with longitudinal axis z (see FIG. 1A) launched along a trajectory tangential to the z-axis, the available shell mass at the ends is relatively small, and, therefore, only a small number of fragments will be ejected in the direction of the projectile's path of flight. Thus, since approximately more then three quarters of the projectile's anterior target space (i.e. ahead of the point of the explosion) is covered with only a small number of fragments, whereas the bulk of the fragment spray is ejected predominantly in the direction normal to the z-axis, the overall effectiveness of cylindrical airburst shells is relatively low. On the other hand, in the case of an idealized spherical shell of the same mass, FIG. 1B, the fragment spray distribution pattern at the quasi-static burst conditions is nearly perfect, but, unfortunately, the concept is impractical for gun-launched munition applications, because of projectile design constraints including payload-to-gun caliber ratio, and projectile stability. In addition, high terminal projectile velocities tend to degrade penetration capability of fragments ejected from the posterior portion of a shell, thereby reducing warhead lethal area by approximately a factor of two compared to that at quasi-static burst conditions.

Figure 1C:
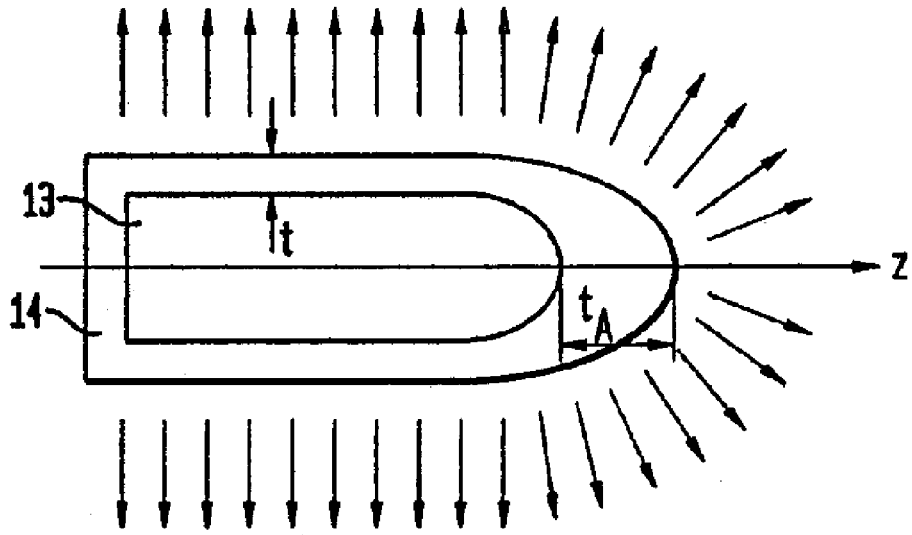
FIG. 1C shows a fragment spray pattern cross-sectionally viewed, of a cylindrical shell device 14 of wall thickness t with front ogive portion having thickness $t_A$ at its tip and tapering down to t at the walls of the cylinder, and having explosive 13 within such shell device.

An alternate approach to the problem is shown in FIG. 1C whereas the ogive-like front portion of the shell is thickened and rounded, $t_A > t$. Thickening and rounding the front portion of the shell enables generation of a fixed number of fragments per unit length of the shell and per unit angle Θ of the target space, which integrates the best features of the two idealized geometries of FIGS. 1A and 1B and maximizes warhead lethality. According to the present invention, the idealized embodiment of a munition such as in FIG. 1C is extended to that of a composite multi-material fragmenting shell of FIGS. 2B and 2C, enabling even greater lethality than that of the single material approach.

Figure 2A:
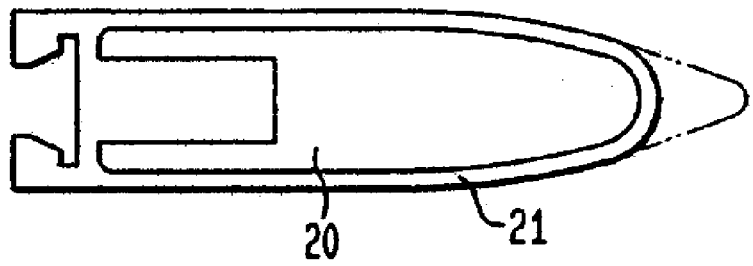
FIG. 2A shows a fragmenting shell 21, similar to fragmenting shell of FIG. 1C, having explosive 20 within, without a fragmenting anterior liner.
Figure 2B:
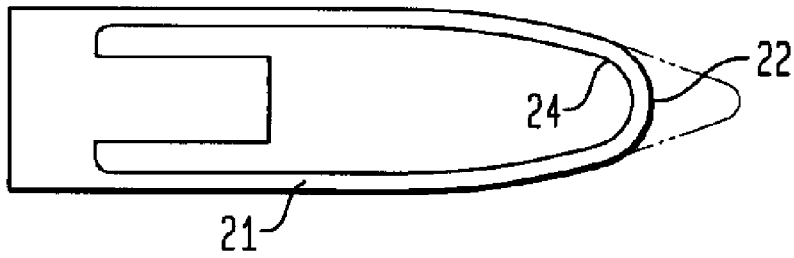
FIG. 2B shows a fragmenting shell 23, similar to fragmenting shell 21 of FIG. 2A, but with a fragmenting anterior liner 22 disposed on an outer surface of a pusher liner 24.
Figure 2C:
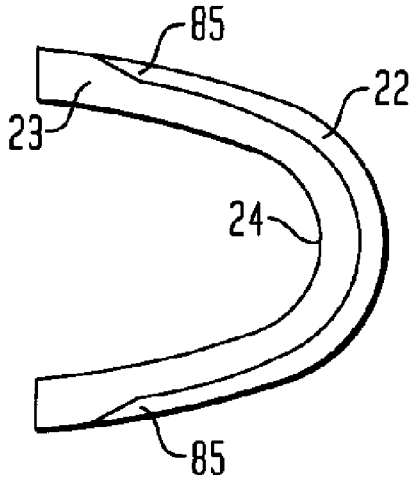
FIG. 2C shows a close-up of the nose of the shell of FIG. 2B having fragmenting shell 23 with a pusher liner 24, and a fragmenting anterior liner 22.

With reference to FIGS. 2A and 2B the cylindrical body portion of the (fragmenting) shell encapsulates the explosive and smoothly blends into a rounded front end 21 and 24. According to the invention, the front portion of a munition comprises a composite fragmentation liner such as shown by a close-up view in FIG. 2C, which has a pusher liner 24 to transfer explosive momentum to the anterior fragmenting liner 22 that projects fragments to the front. Pusher liner 24 here is actually a part of the front portion 21 of the munition shown in FIG. 2B. Since the munition may have to withstand high-G gun-launch loads, a material of choice for the main fragmenting shell 21 and pusher liner 24 are high-strength grades of steel. In order to avoid premature rupture of a shell and leakage of the detonation products, the end parts of the fragmenting anterior liner 22 are tapered such as 85 shown in FIG. 2C, smoothly blending with the main fragmenting shell; a proper taper of the liner is a key factor for maximizing efficiency of the warhead. In order to optimize preferred fragment size distribution, the anterior liner could be multi-layered comprising of a series of two or more layers of liners stacked to each other (FIG. 6A), rather than just the one-piece single anterior liner shown in FIG. 2C.

To generate an approximately fixed number of fragments per unit length of the shell, significant amount of shell mass is required in the front, so the anterior liner has to be fabricated from a high-density, preferably, structurally robust high-strength material. Another rationale for using high-density high-strength metals and metal alloys is the superior penetration efficiency of these materials, enabling generation of larger numbers of lethal fragments per unit mass of fragmenting shell, and significantly increasing the warhead lethality. Accordingly, a material which can be chosen for the fragmenting anterior liner is tungsten alloy; it has both high density and also high strength properties. The anterior liner could also be made from a variety of other high-density structurally robust metals and metal alloys including tantalum, hafnium, lead, and depleted uranium.

Images in FIG. 3 show the effectiveness of the embodiment of the munition of FIG. 2B having a tungsten alloy anterior fragmenting liner 22 versus a baseline "all-steel" airburst warhead of FIG. 2A of the same mass of steel. The assessment of the lethality of both munitions had been performed by taking into account a complex battlefield scenario of an assault against a typical combat-personnel target including the number and positions of soldiers, the soldiers' posture, and combined effects of helmets, body armors and unprotected portions of the body. Accordingly, images in polar area graphs of FIGS. 3D and 3B show the resulting munition lethality plots, representing statistical predictions of probabilities of body wounds that incapacitate targeted combatants preventing them from active resistive actions. The input for the statistical lethality analyses included the fragment velocity and mass distribution from the continuum physics and the fragmentation physics computations at static burst conditions, plus projectile terminal ballistics parameters at the given range, including warhead velocity at burst, orientation of warhead, the height of burst, and other factors. As shown in images of FIG. 3D versus that of FIG. 3B, assuming ideal fragmentation (0% losses) of the anterior liner 22, the lethal area of the invented munition is more than four to eight times that of the baseline warhead of FIG. 2A. The enormous gain in the warheads lethality is due to the multiplicity of high-lethality tungsten alloy fragments ejected by the anterior liner 22 that fill the entire front space 45 of the warhead between "bat wings" 41 and 43.

As is illustrated in the drawings, according to the current invention the pusher liner and the anterior liner interface are rounded and curved. This is an important feature of the current invention that, in addition to achieving a uniform distribution of fragment mass per unit Θ-angle, also produces high-strain high-strain-rate continuum flow both in the circumferential (hoop) direction and in the tangential direction along the projectile axis enabling uniform fracturing of the liner material. Accordingly, in order to maximize the warhead performance and to achieve the optimum fragment distribution parameters, the pusher liner and the anterior liner have to have properly engineered surface profiles, thicknesses, and curvatures. According to the current invention, the preferable mathematical formulation of the pusher liner and the anterior liner surfaces is given by the following equations:

$$\vec{R}(\xi)=\vec{a}_0+\vec{a}_1\xi\,\vec{a}_2\xi^2+\vec{a}_3\xi^3$$

$$\vec{R}(\xi)=r(\xi)\hat{\imath}+z(\xi)\hat{\jmath}$$

$$\vec{a}_0=\vec{R}(0)$$

$$\vec{a}_1=\vec{R}(0)=\alpha_0\vec{T}(0)$$

$$\vec{a}_2=\vec{R}(0)=\alpha_0\vec{T}(0)$$

$$\vec{a}_3=3[\vec{R}(1)-\vec{R}(0)]-2\vec{R}(0)-\vec{R}(1)=3[\vec{R}(1)-\vec{R}(0)]-2\alpha_0\vec{T}(0)-\alpha_1\vec{T}(1)$$

$$\vec{a}_4=2[\vec{R}(0)+\vec{R}(1)]+\vec{R}(0)-\vec{R}(1)=2[\vec{R}(0)-\vec{R}(1)]+\alpha_0\vec{T}(0)+\alpha_1\vec{T}(1)$$

Figure 2D:
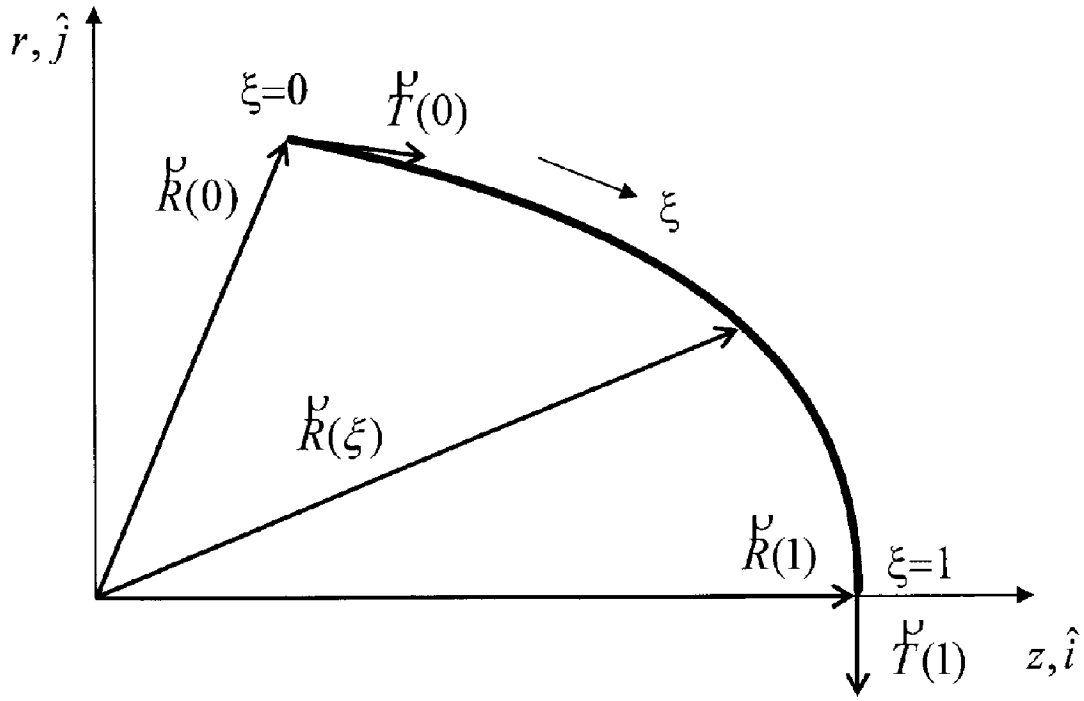
FIG. 2D is a representation of a third-order parametric vector curve segment (nine degrees of freedom) useful in design of the liners.

The equations above represent a third-order parametric vector curve segment $\vec{R}(\xi)$ shown in FIG. 2D, whereas vector $\vec{R}(\xi)$ is a function of a scalar dimensionless parameter $\xi$, $0\leqq\xi\leqq1$; z and r are the axial and radial coordinates, and $\hat{\imath}$ and $\hat{\jmath}$ are the unit-directional vectors corresponding to coordinate axes z and r, respectively. As shown in the figure, vectors $\vec{R}(\mathbf{0})$ and $\vec{R}(\mathbf{1})$ denote the start point $\xi=0$ and the end point $\xi=1$ of the curve segment $\vec{R}(\xi)$, respectively; vectors $\alpha_0\vec{T}(\mathbf{0})$ and $\alpha_1\vec{T}(\mathbf{1})$ are the tangents at these two points with lengths $\alpha_0$ and $\alpha_1$, respectively. Although the required shape of the pusher and anterior liners may be achieved employing a number of other high order curve and/or spline equations, the advantage of the above formulation is that, in addition to superior curve design flexibility, the shape of the curve segment is conveniently controlled using positions of two end points and tangents thereof.

Figure 3A:
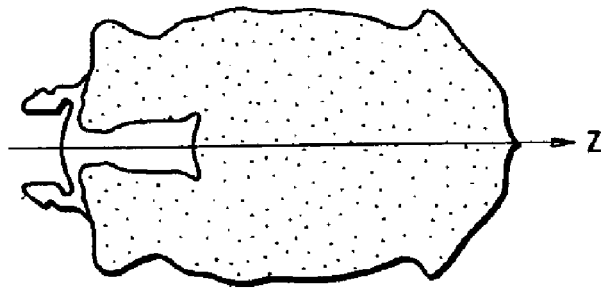
FIGS. 3A-3D show results of analyses of fragmentation patterns of two airburst munition embodiments considered: a baseline fragmenting shell of FIG. 2A with reference to FIGS. 3A and 3B; and a composite fragmenting shell of the present invention of FIG. 2B, with reference to FIGS. 3C and 3D. Images in FIGS. 3A and 3C represent computed images of positions of materials of these two munitions after the explosives are detonated and the metal shells are about to break up ejecting a spray of fragments into the air over the target on the ground. Images in FIGS. 3B and 3D are polar graphs showing results of analyses of the probability of incapacitation of combat personnel situated on the ground in the area of the explosive burst. The graphs are drawn in the plane of the ground, whereas the z-axes are in a direction of the projection of the shell's velocity at the time of the burst, and the angles Θ represent projections of angles between velocities of the fragments and the z-axes. The black-and-white-coded areas in these graphs represent contours of "lethal" zones on the ground, the darker the shade is, the higher is the probability of incapacitation. Accordingly, the graph of FIG. 3B shows that the "lethal" zone of the baseline munition of FIG. 2A is confined to the two dark-shaded "bat wing" shaped areas 41 and 43 filled with the spray of fragments ejected from the cylindrical portion of the shell, and elsewhere the lethality of the warhead is relatively low. To the contrast, the wide-angle fan shaped lethal area 45 of the graph of FIG. 3D is according to the present invention of FIG. 2B. As shown in the graphs, the lethal area of this munition (see FIG. 3D versus FIG. 3B) is more than four to eight times that of the baseline warhead of FIG. 2A. The enormous gain in the warheads lethality is due to fragments ejected by the anterior liner 22 that fill the entire front space 45 of the warhead between the "bat wings" 41 and 43 with fragments.
Figure 3B:
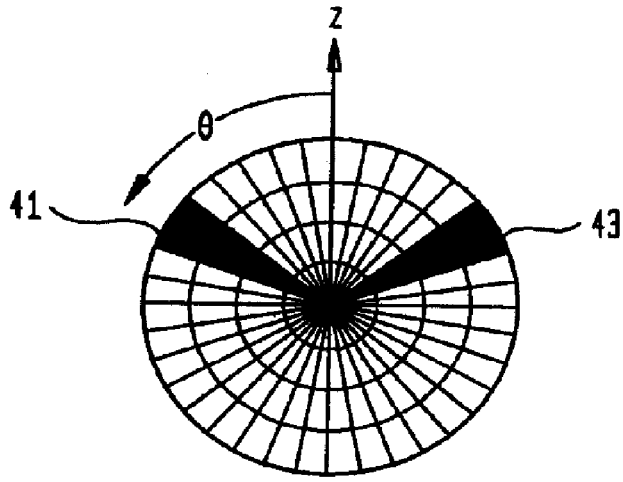
Figure 3C:
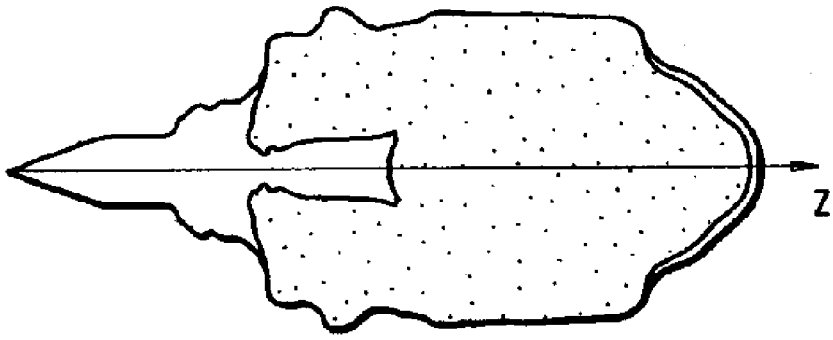
Figure 3D:
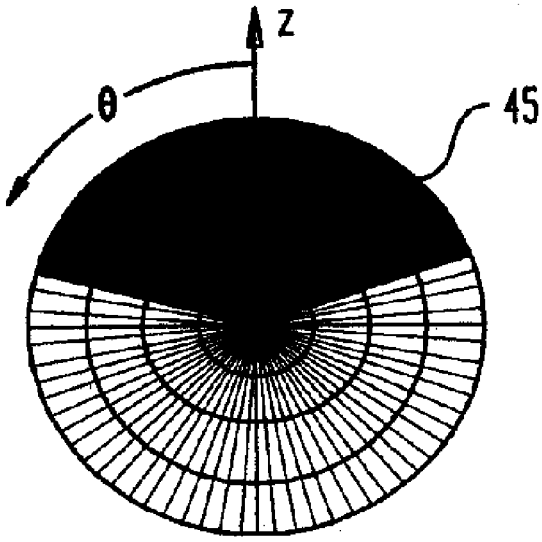
Figure 4:
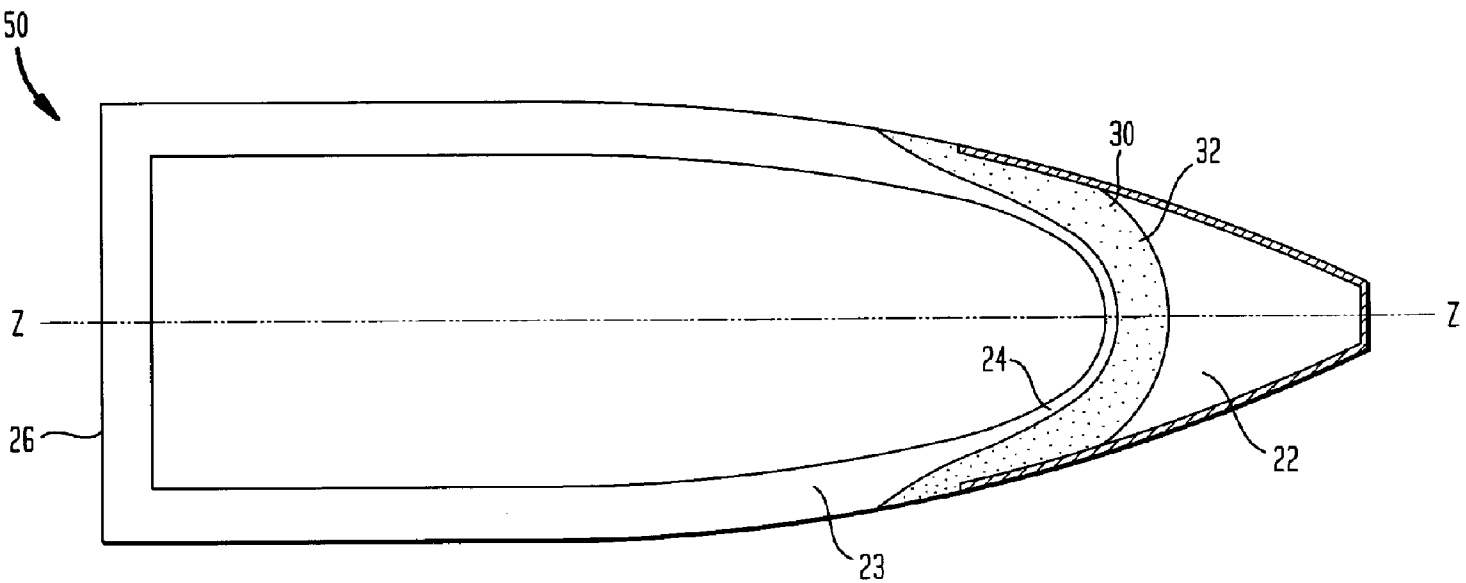
FIG. 4 is a schematic sectional view of another embodiment of a munition according to the invention, which shows anterior liner 22 comprised of high density high strength fragments 30 embedded in metal alloy matrix.

According to the current invention, properly engineering surface profiles of the pusher and anterior liners, preferably with use of the above equations, enables efficient uniform fracturing of high-strength fragmentation liner materials including high-strength steel pusher liners, solid homogenous tungsten alloy anterior liners (with and without scoring as in FIGS. 5 and 6), and heterogeneous anterior liners made of preformed fragments embedded in metal alloy matrix (such as in FIG. 4). In addition, the present invention, as shown in FIG. 3D, achieves an even density in lethal fragments in a radial distribution including the direction of flight making use of the entire body of the anterior liner, without any low-strength light-weight preformed fragment bonding material, for example, that does not contribute to the munition lethality, but may interfere with the fragments hitting their targets. The multi-layered anterior liner of this invention can be prefabricated and then disposed on the outer surface of the pusher liner in a high throughput production manner, with easy access for assembly and quality inspection, to assure consistent performance.

Thus, according to the invention, the anterior liner can be made either from a homogeneous solid high-density high-strength material or from a multiplicity of high-density high-strength preformed fragments embedded in a metal alloy matrix (as in FIG. 4), all in spatially compact and structurally robust manner with appreciable structural strength. Accordingly, a material of choice for the preformed anterior liner is preformed tungsten alloy fragments embedded in tungsten alloy matrix. In the case of the solid homogeneous anterior liner, in order to produce preferred fragment sizes the liner can be fabricated with surface patterns of scores (as in FIG. 5) or holes (as in FIG. 6B).

FIG. 4 is a schematic sectional view of an embodiment of a munition 50 according to the invention having an anterior liner 22 made of a multiplicity of high-density high-strength preformed fragments 30 embedded in a high-density high-strength metal alloy matrix 32. Munition 50 is similar to that of FIG. 2C but here, anterior liner 22 comprises matrix material 32 holding fragments 30 disposed therein and shaped, for example, as spheres, cubes or other shapes. According to the current invention, the strength of the bond between the embedded fragments and the matrix material, or the strength of the matrix material proper can be only slightly weaker, so that under the conditions of high-strain high-strain-rate fracture the embedded fragments remain intact and cleanly separate from each other and the matrix without breaking up. Properly engineering surface profiles of the pusher and anterior liners, preferably with use of equations given above, produces high-strain high-strain-rate continuum flow both in the circumferential (hoop) direction and in the tangential direction along the projectile axis enabling uniform fracturing and preventing embedded fragments from conglomerating each with other. The masses of fragments of the munition 50 are in a range of approximately ½ grains to 3 grains, or as desired. For anti-personnel missions the smallest sizes can be used; however there is a lower threshold of fragment sizes where any smaller fragments will not be effective against combatants protected with body armor and helmet. Larger sized fragments above 5 grains suitable for anti-vehicle and light anti-armor missions, e.g., can be packed together with the smaller anti-personnel fragments, since a combination of smaller and larger fragments sizes not only increases the liner packing density, but also enables diverse operational functions indispensable in complex modern battlefield scenario.

The second layer here (36) is attached to the first layer (the pusher liner 34) for example by an adhesive or by shrink fitting.

Figure 5:
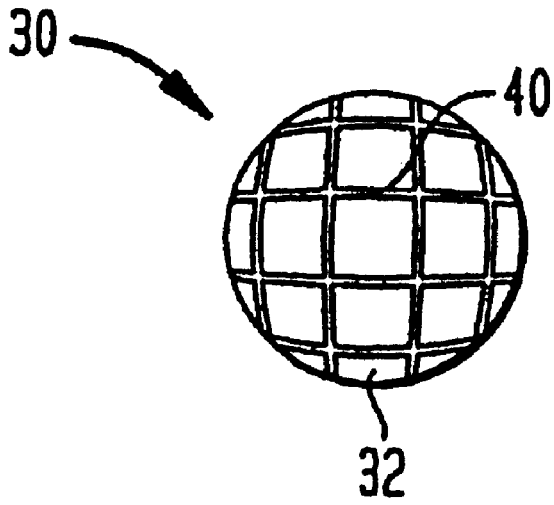
FIG. 5 is a front view of a munition (such as FIG. 2B) which shows the addition of scoring.

FIG. 5 is a front view of a munition such as 30 of FIG. 4 but with scoring 40 (for example, grooves) in the second layer 36 of the rounded shell portion 32. The surface pattern of scores helps to further produce preferred fragment sizes upon detonation. Having closer scoring patterns will yield more fragments upon detonation, however there is a lower practical limit to the size of fragments for purposes of lethality, and even in a physical ability to make scoring grooves on the item.

Figure 6A:
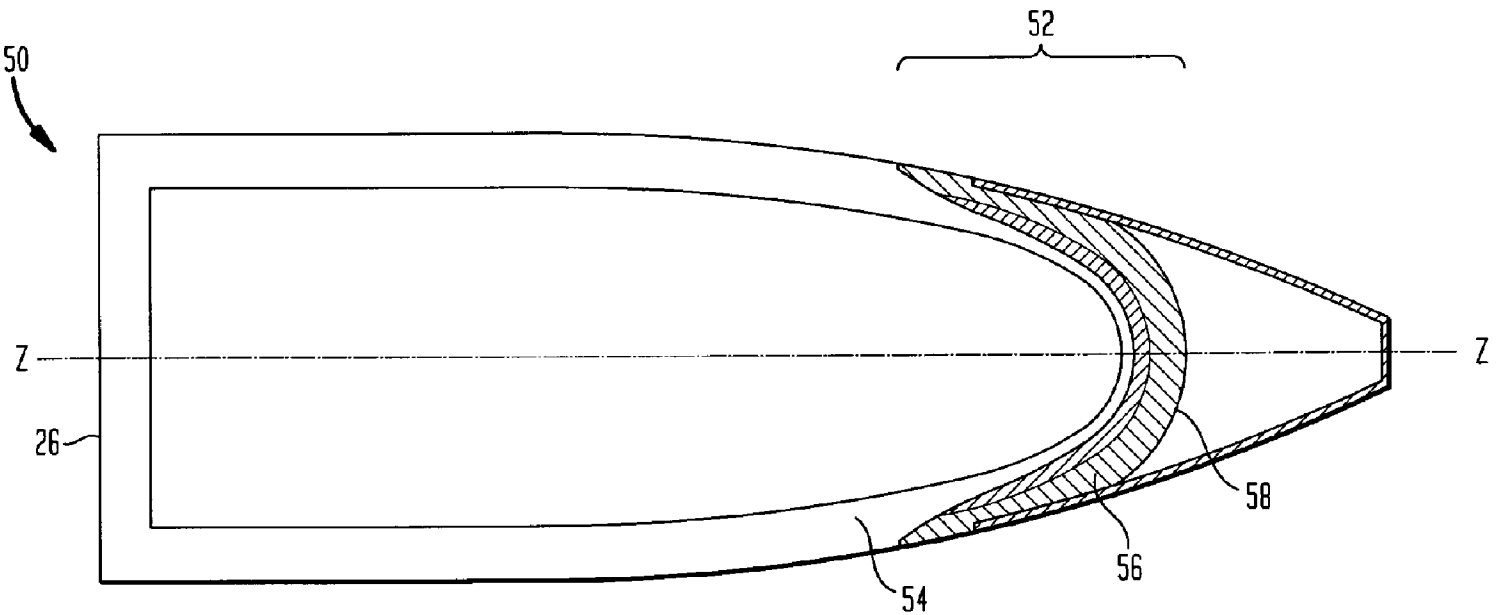
FIG. 6A is a sectional view of another embodiment of a munition according to the invention, which shows a multi-liner nose section.

FIG. 6A is a sectional view of another embodiment of a munition 50 according to the invention with yet an additional liner inserted therein. Munition 50 in FIG. 6A is similar to munition 30 in FIG. 4, except the rounded shell portion 52 includes three layers 54, 56, 58. FIG. 6A has not been drawn to scale and its features are exaggerated to show presence of multiple liners in a warhead. The first layer 54 comprises the same material as the cylindrical shell portion 26. The second layer 56 is disposed on an outer surface of the first layer 54. The third layer 58 is disposed on the outer surface of the second layer 56. The material of the second layer 56 may be the same as or different than the material of the third layer 58. The material of the second and third layers 56, 58 may be, for example, a high density, high strength material such as tungsten, tantalum, lead or depleted uranium. FIG. 6A has been drawn with an exaggerated nose area with widths out of actual proportion; the nose cone shown in the FIG. 2 examples is more nearly a realistic proportion.

Either or both of the second and third layers 56, 58 may have fragments disposed therein, in a similar fashion as shown with reference to layer 36 in FIG. 4. The second layer 56 is attached to the first layer 54 and the third layer 58 is attached to the second layer 56 by, for example, an adhesive or shrink fitting. Third layer 58 may also be scored, as discussed above with reference to layer 36 of FIG. 5.

Figure 6B:
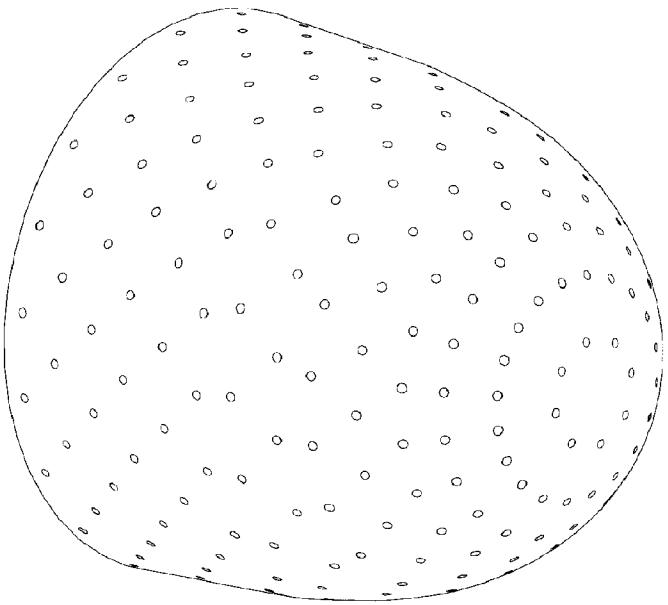
FIGS. 6B-6G show a schematic views of another embodiment of a munition according to the invention, which shows the addition of small holes in the anterior liner and, alternatively, also in other parts of the fragmenting munition body.
Figure 6C:
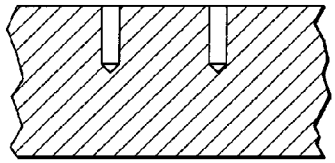
Figure 6D:
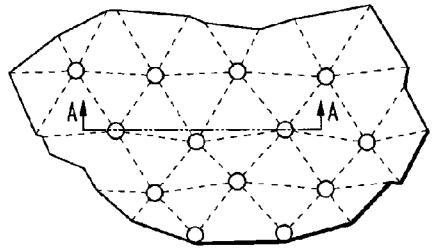
Figure 6E:
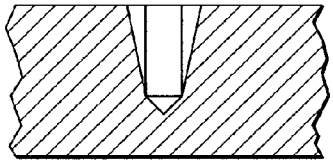
Figure 6F:
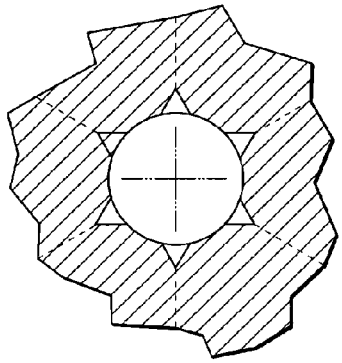
Figure 6G:
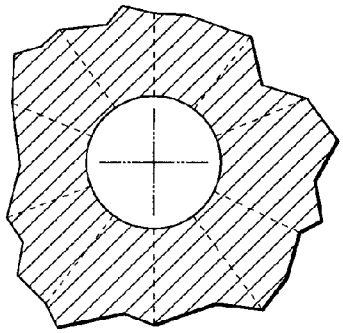

FIGS. 6B-6C show a schematic sectional view of another embodiment of a munition according to the invention, which shows addition of a series of relatively small diameter sized holes in the anterior liner (and alternatively also in other parts of the munition body). The small holes have also proven to be a good way to have the warhead to break up into suitable fragments for the desired effect of anti-personnel and anti-small armor targets. The holes may take on a variety of cross-sectional shapes such as round, square, star-like shaped; the holes may be all the way through holes, or partially through (dimples) or other embodiments (see examples FIGS. 6B-6G).

It is possible to employ for good effect, in a single warhead, all or any combination of the three features of embedding fragments (FIG. 4), scoring (FIG. 5), and also of adding the small holes such as in FIGS. 6B-6G. This further could be carried over into multiple liner warheads such as in FIG. 6A, in various combinations. If holes and scoring were both being used, then the placement of holes should be between scoring grooves.

Figure 7:
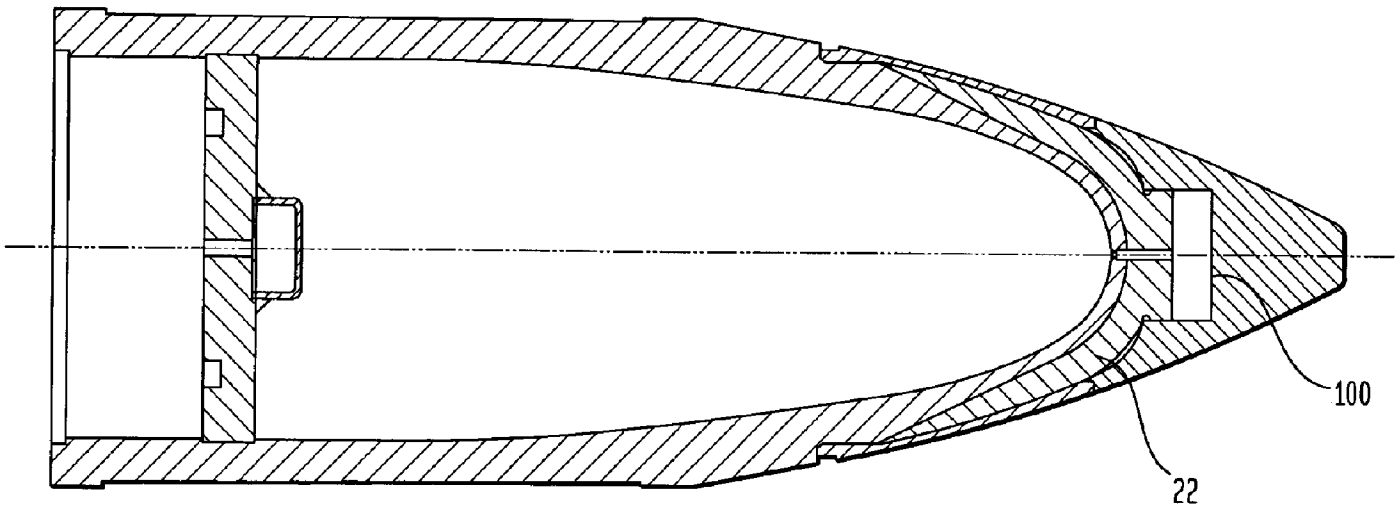
FIG. 7 is a sectional view of another embodiment of a munition according to the invention that can act as a high-strength kinetic energy projectile capable of breaching light armor and reinforced concrete and masonry walls in urban terrain military operations. According to the invention, high-density high-strength anterior liner 22 has a blunt-shaped flat nose 100 that reduces the ricochet and improves projectile penetration stability at oblique impact angles.

FIG. 7 is a sectional view of another embodiment of a munition according to the invention that can act as a high-strength kinetic energy projectile capable of breaching light armor and reinforced concrete and masonry walls in urban terrain military operations. According to the invention, high-density high-strength anterior liner 22 has a blunt-shaped flat nose 100 that reduces the ricochet and improves projectile penetration stability at oblique impact angles.

While the invention has been described with reference to certain preferred embodiments, numerous changes, alterations and modifications to the described embodiments are possible without departing from the spirit and scope of the invention as defined in the appended claims, and equivalents thereof.

What is claimed is:

1. An explosive fragmentation munition having a longitudinal axis, comprising:

a single-layered, generally cylindrical shell portion having a thickness;

an exposed rounded nose having a thickness, the nose being disposed at a front end of the cylindrical shell portion;

an explosive disposed inside the cylindrical shell portion and the nose;

wherein the nose includes a pusher liner that is made of a similar material as the cylindrical shell portion, and a multi-layered anterior liner that is disposed on an outer surface of the pusher liner;

wherein the multi-layered anterior liner is made of a high-density material that is different from the material of the cylindrical shell portion and that adds mass to the nose, so that the pusher liner transfers momentum to the anterior liner, which, in turn, projects fragments in a forward direction; and wherein the anterior liner includes a plurality of holes that cause the munition to fragment into a plurality of small fragments.

2. The munition of claim 1 wherein the anterior liner contains preformed fragments disposed therein.

3. The munition of claim 1 the anterior liner includes scoring on an outer surface thereof.

4. The munition of claim 1 wherein the material of the pusher liner is steel.

5. The munition of claim 1 wherein the anterior liner is made at least in part of tungsten alloy and contains preformed fragments embedded in an alloy matrix.

6. The munition of claim 1 wherein the anterior liner is multi-layered and comprises at least a first layer made of a material that is selected from the group consisting of tungsten, tantalum, hafnium, lead, and depleted uranium alloys.

7. The munition of claim 6 wherein the multi-layered anterior liner comprises a second layer that is made of a material selected from the group consisting of tungsten, tantalum, hafnium, lead, and depleted uranium alloys.

8. The munition of claim 7 wherein the anterior liner comprises a third layer that is stacked on the second layer.

9. The munition of claim 8 wherein the third layer is made of a material that is selected from the group consisting of tungsten, tantalum, hafnium, lead, and depleted uranium alloys.

10. The munition of claim 9 wherein the anterior liner contains fragments disposed therein, intermediate the first layer and the second layer.

11. The munition of claim 10 wherein said fragments may be shaped as spheres or cubes.

12. The munition of claim 10 wherein the material density of the embedded fragments is different from the anterior liner, to aid in separation of the embedded fragments upon detonation.

13. The munition of claim 9 wherein the anterior liner contains fragments disposed therein, intermediate the second layer and the third layer.

14. The munition of claim 1, wherein the cylindrical shell portion has a generally uniform thickness.

15. The munition of claim 1 wherein small holes are placed in the exterior body of the munition, to aid in breakup of the warhead when it fragments.

16. The munition of claim 15 wherein small holes are placed in the front cap area of the munition, to aid in breakup of the warhead when it fragments.

17. The munition of claim 15 wherein the small holes are star-shaped cross-sectionally.

18. The munition of claim 1 wherein the shape of the warhead anterior layer is non-conical, and is patterned from a third order parametric polynomial curve.

19. The munition of claim 1 wherein the warhead contains no plastic material.

* * * * *